US009137618B1

(12) United States Patent
Waller, Jr. et al.

(10) Patent No.: US 9,137,618 B1
(45) **Date of Patent: *Sep. 15, 2015**

(54) MULTI-DIMENSIONAL PROCESSOR AND MULTI-DIMENSIONAL AUDIO PROCESSOR SYSTEM

(76) Inventors: James K. Waller, Jr., Clarkston, MI (US); Jon J. Waller, Waterford, MI (US); Russell W. Blum, Chesterfield, MI (US)

( * ) Notice: Subject to any disclaimer, the term of this patent is extended or adjusted under 35 U.S.C. 154(b) by 3234 days.

This patent is subject to a terminal disclaimer.

(21) Appl. No.: 11/132,010

(22) Filed: May 18, 2005

Related U.S. Application Data

(63) Continuation of application No. 09/362,266, filed on Jul. 28, 1999, now Pat. No. 6,931,134.

(60) Provisional application No. 60/094,320, filed on Jul. 28, 1998.

(51) Int. Cl.
*H04R 5/00* (2006.01)
*H04S 1/00* (2006.01)

(52) U.S. Cl.
CPC .. *H04S 1/002* (2013.01); *H04R 5/00* (2013.01)

(58) Field of Classification Search
CPC ..... H04S 1/00; H04S 1/002; H04S 1/005; H04S 3/00; H04S 3/002; H04S 3/02; H04R 3/00; H04R 3/04; H04R 5/00; H04R 5/027
USPC ..... 381/27, 119, 1, 18–19, 307
See application file for complete search history.

(56) References Cited

U.S. PATENT DOCUMENTS

| | | | | |
|---|---|---|---|---|
| 3,772,479 | A | 11/1973 | Hilbert | |
| 4,024,344 | A | 5/1977 | Dolby et al. | |
| 4,027,101 | A | 5/1977 | De Freitas et al. | |
| 4,039,755 | A * | 8/1977 | Berkovitz | 381/63 |
| 4,384,505 | A * | 5/1983 | Cotton et al. | 84/708 |
| 4,574,391 | A | 3/1986 | Morishima | |
| 4,747,142 | A * | 5/1988 | Tofte | 381/27 |
| 4,841,573 | A | 6/1989 | Fujita | |
| 5,046,098 | A * | 9/1991 | Mandell et al. | 381/22 |
| 5,128,999 | A * | 7/1992 | Yanagawa | 381/22 |
| 5,197,100 | A | 3/1993 | Shiraki | |
| 5,528,694 | A * | 6/1996 | Van De Kerkhof et al. | 381/27 |
| 5,530,760 | A * | 6/1996 | Paisley | 381/27 |
| 5,610,986 | A | 3/1997 | Miles | |
| 5,854,847 | A | 12/1998 | Yoshida et al. | |

FOREIGN PATENT DOCUMENTS

GB 2074427 10/1981

* cited by examiner

*Primary Examiner* — Xu Mei
(74) *Attorney, Agent, or Firm* — Gable Gotwals; Frank J. Catalano

(57) ABSTRACT

A multi-dimensional audio processor receives as an input either a single channel signal or a two channel signal from an audio signal source; for example a musical instrument or an audio mixer. The processor is programmable to divide the input among at least 3 output channels in a user-defined manner. The processor is also user programmable to provide a variety of effect and mixing functions for the output channel signals.

1 Claim, 24 Drawing Sheets

Figure 1 - Prior Art

Figure 2 - Prior Art

Figure 3 - Prior Art

MULTI-DIMENSIONAL PROCESSOR AND MULTI-DIMENSIONAL AUDIO PROCESSOR SYSTEM

This application is a continuation of application Ser. No. 09/362,266, filed Jul. 28, 1999 now U.S. Pat. No. 6,931,143 for "Multi-Dimensional Processor and Multi-Dimensional Audio Processor System" which is a Provisional of 60/094,320 filed Jul. 28, 1998.

BACKGROUND OF THE INVENTION

1. Field of the Invention

The present invention relates to an audio processing apparatus for receiving an at least one channel input signal and providing a plurality of user-defined effect and mixing functions for processing the input signal to generate an at least 3 channel output signal.

2. Description of Related Art

In the past it has been known in the art of audio processing to use so-called effect units for enriching the sound quality of an audio signal through the application of effects processing; i.e., the application of effects such as chorus, flange, delay, pitch shift, compression and distortion, among others; and for providing simulation of physical audio phenomena, such as speaker characteristics and room reverberation. FIG. 1 shows an exemplary use of a prior effect unit. Effect processor 10 receives input signal 12 from audio source 11*a-c*, typically input signal 12 is either a single channel; i.e., mono; signal or a two channel stereo signal from musical instrument 11*a-b* or audio mixer 11*c*. Effect unit 10 provides user definable analog and/or digital signal processing of input signal 12 and provides output signal 13, which is either a mono signal or a stereo signal, to amplifiers 14*a-b* or audio mixer 14*c*. Recently it has become standard to provide effect unit 10 with the functionality of several effects which the user; e.g., a musician; can arrange into a desired processing order; i.e., a user defined effects chain; thereby allowing the user to tailor the operation of effects unit 10 to achieve a desired audio result for output signal 13. As a particular example of the prior art, guitar systems have been known and used for years that provide guitar signal processing to simulate the characteristics of the tube guitar amplifier and speakers. With digital signal processing, currently available systems offer both the guitar signal processing (amplifier simulation) and effects processing. The systems of today lack any aspect of multi-dimensionality in the reproduction of the processed output. That is, all of the commercially available systems offer only stereo outputs which lack the requirements to offer a multi-dimensional reproduction of the sound. Custom system builders have built guitar systems for some of the professional touring guitarists with a three channel setup. Referring to FIG. 2, a diagram of the prior art three channel custom system is shown. These systems have typically been configured with amplifier stack 20 in the middle to reproduce the direct guitar signal. Typically the line output of direct guitar amp 21 is fed to the input of stereo effects processor 22. The output of stereo effects processor 22 is fed to stereo power amplifier 23 which powers two speaker cabinets 24*a-b* placed one on each side of direct guitar amplifier 21. In these systems the center channel will provide what is referred to as the dry guitar signal while the side speakers provide effect enhancement. For example, many of the stereo effects processors include echo algorithms where the echo will "ping-pong" between the two output channels and multi-voice chorus or pitch shifting algorithms. While these custom systems start to approach the potential of a multi-dimensional guitar audio processor they fall short in that there is not total flexibility for the user to define the location of the various effects within the three channel system. In summary, the prior art in this area lacks the ability to provide more than two output channels which are each derived from an at least one channel input signal and internally effected signals.

A second area of prior art related to the present invention is the commonly known surround sound audio system which has been finding wide application in the movie/home theater environment. FIG. 3 shows an exemplary surround sound system which includes audio signal source 31, which is typically recorded audio, for providing input signal 35 to surround decoder 30 and speakers 32*a-c*, 33*a-b*, 34 which receive dedicated signals from the outputs of decoder 30. Input signal 35 is typically a stereo signal, which may be encoded for surround playback, and decoder 30 processes the input signal to generate dedicated output channels for the left, center, and right front speakers 32*a-c*, the left and right rear; i.e. surround; speakers 33*a-b* and subwoofer 34. In one particular prior art surround sound decoder, the DC-1 Digital Controller available from Lexicon, Inc., additional signal processing is provided which simulates the reverberation characteristics of any of several predefined acoustic environments with fixed source and listening positions, where the source and listening positions are modeled as points in the simulated environment. The user/listener can then create the acoustic ambience of; e.g., a concert hall in a home listening environment. Limited user editing of environment parameters is also provided so that custom environments can be defined. The prior art in this area lacks multi-effect functionality/configurability and mixing functionality which would allow the user/listener to independently define the signal for each output channel in terms of input signal 35 and internally effected signals and is typically limited to stereo input signals from prerecorded audio sources. Additionally, this area of prior art lacks the flexibility of being able to vary source and listening positions in a simulated acoustic environment.

SUMMARY OF THE INVENTION

The present invention has as its objects to overcome the limitations of the prior art and to provide a musician or other user with a variety of multi-dimensional effects. The present invention can also provide user programmable multi-effect functionality and configurability with extensive signal mixing capabilities which allow the user to independently define each channel of a multi-dimensional output signal in terms of a mix of the input audio signal and a plurality of effected/processed signals output from at least one effects chain. It is a further object of the present invention to extend the modeling of audio sources from point sources to multi-dimensional sources so that the acoustic characteristics of, for example, a large instrument such as a grand piano can be more accurately simulated. It is also an object of the present invention to provide a multi-dimensional output signal which emulates the acoustic aspects of a variety of acoustic environments. As such, the present invention moves sonic perception to a new level by resolving and replicating more of the subtle detail of the true multi-dimensional acoustical event.

A multi-dimensional audio processor according to the present invention comprises input means for accepting an at least one channel input signal from an audio signal source; e.g. a musical instrument or audio mixer; and outputting a multi-dimensional signal comprised of three or more channels of processed audio signals which are derived from the input audio signal.

The present invention also encompasses a multi-dimensional audio processor system which, in a first embodiment, comprises an input audio source, a multi-dimensional audio processor wherein digital signal processing (DSP) algorithms are provided to impart effects to an input signal and generate output signals which are a mix of the input signal and effected signals, and means for converting the output signals to sound waves, thereby providing a musician or other user with multi-dimensional effects enhancement. For example in a five channel system set up like that of a home surround sound system with a guitar providing the input/direct signal, the direct signal could be programmed to emanate predominantly from the front center with the other four channels providing the direct signal ten decibels lower than that of the front center. Effects can then be added, for example where an echo can ping-pong from one speaker to the next adjacent speaker producing a circling echo effect. Echos can also bounce in any other predefined pattern desired by the performer. Further effects can be added to produce, for example, a five voice chorus where each voice has a non-correlated output; e.g., with different time delay and modulation settings for speed and depth; and is directed to a respective output channel. A multi-dimensional reverb, as will be described in greater detail later, can also be added whereby each output is a true representation of the reflections from various acoustical environments. The resulting sonic output of the system provides a multi-dimensional impact not previously available. As yet another example, a five voice guitar pre-amp can provide a different guitar signal as an output in each channel of the system. The user could program a high gain distorted signal in the front center channel with a differently equalized clean and compressed signal in the front left and right channels, while still providing a slightly distorted and differently equalized dry guitar signal in both the left and right rear channels. When different effects are added to the different channels, the sonic impact is incredibly multi-dimensional.

In a second embodiment of the multi-dimensional audio processor system of the present invention, a multi-dimensional output that emulates the sonic quality of a live instrument is produced. As an example, in a live performance where a musician is playing an acoustic guitar. The guitar is not just a single point source in relation to the players ears. Certainly the room reflections provide a portion of the realness perceived by the player but there is still more that contributes to the live impact. The acoustic guitar has a large resonating area in the body of the guitar. The back side of the guitar body also provides sonic contribution to the performer. The direct sound, or sonic fingerprint, from the instrument as heard by the performer is truly multi-dimensional. Sound from the front of the instrument will have a different amplitude, phase and frequency response than sound the ears perceive from the back or top side of the instrument. The current invention can be used to model the sonic fingerprint of the acoustic guitar as perceived by the performer. It would be possible to record for later playback the true sonic fingerprint of the acoustic guitar using a discrete multi-channel recording and playback system. By also adding multi-dimensional reverberation to the output the system, listeners could truly achieve the sonic impact comparable to that a performer might hear in a live concert. This kind of sonic impact has never before been possible prior to this invention. The sonic fingerprint of other instruments can also be emulated to provide the same sonic impact for those instruments or for applying the sonic fingerprint of an emulated instrument to a performer's instrument, for example creating the impression of a grand piano by applying the sonic fingerprint of a grand piano to the signal from an acoustic guitar.

In a third embodiment of the multi-dimensional audio processor system according to the present invention, the input to the system is not a specific audio source or instrument but electronic control signals, such as MIDI signals, for controlling the operation of a signal or voice generator incorporated with a multi-dimensional processor, to create a multi-dimensional instrument. Keyboard synthesizers have been used for many years to generate an output signal or voice by various methods. Most keyboards today provide selection of any number of sampled instrument sounds which are reproduced instantaneously when a specific key is actuated and generally provide a stereo output similar to that of the previously described effect processors. With the present invention a performer can select the voice, such as a concert grand piano, to be generated by a synthesizer and the voice can undergo the proper transfer function in digital signal processing so as to provide a multi-dimensional output signal with or without added multi-dimensional effects. This multi-dimensional output can be used for either live performances or recorded with one of the current discrete multi-channel digital systems such as the digital video disk (DVD). In the latter case the end listener will derive the sonic impact of the multi-dimensional audio processor from the multi-channel recording. Other sampled sounds such as that of drums could be recalled and processed with the invention so as to offer the increased sonic reality provided by the current invention.

According to a fourth embodiment of the multi-dimensional audio processor system according to the present invention, a multi-dimensional processor provides a virtual acoustic environment (VAE) for emulating the perceptual acoustic aspects, such as reverberation, of a variety of acoustical environments.

BRIEF DESCRIPTION OF THE DRAWINGS

Other objects and advantages of the invention will become apparent upon reading the following detailed description and upon reference to the drawings in which.

While the invention will be described in connection with preferred embodiments, it will be understood that it is not intended to limit the invention. On the contrary, it is intended to cover all alternatives, modifications and equivalents as may be included within the spirit and scope of the invention as defined by the appended claims.

DETAILED DESCRIPTION OF THE INVENTION

Figure 1:
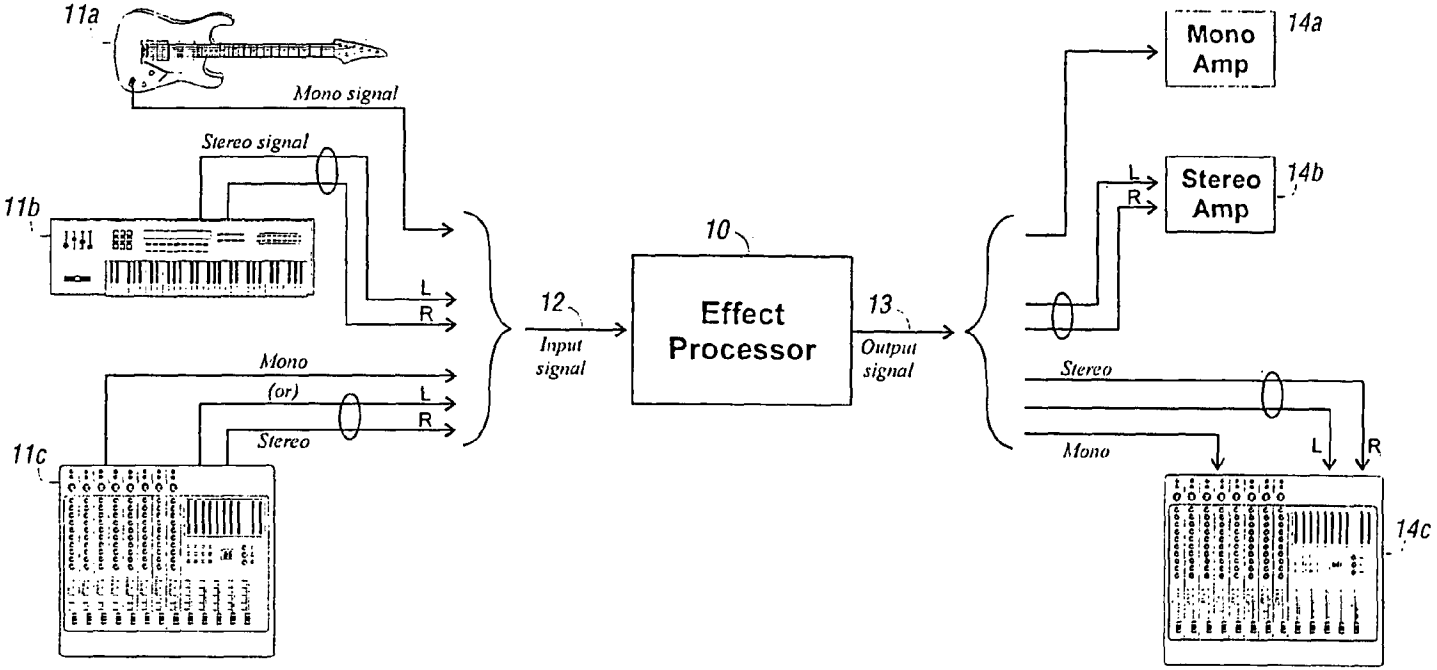
FIG. 1 depicts a prior multi-effects processor system.
Figure 2:
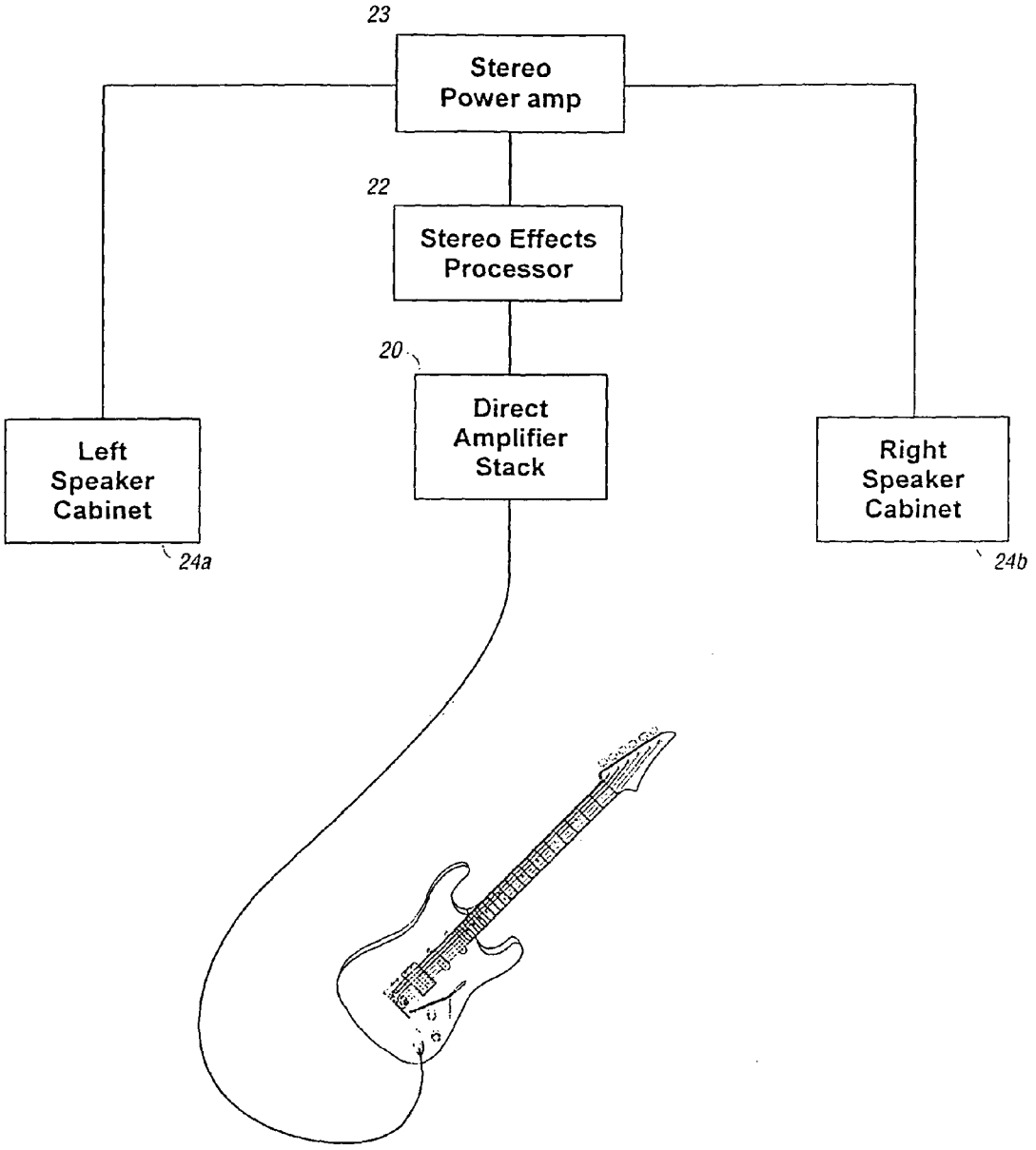
FIG. 2 depicts a prior 3 channel guitar system.
Figure 3:
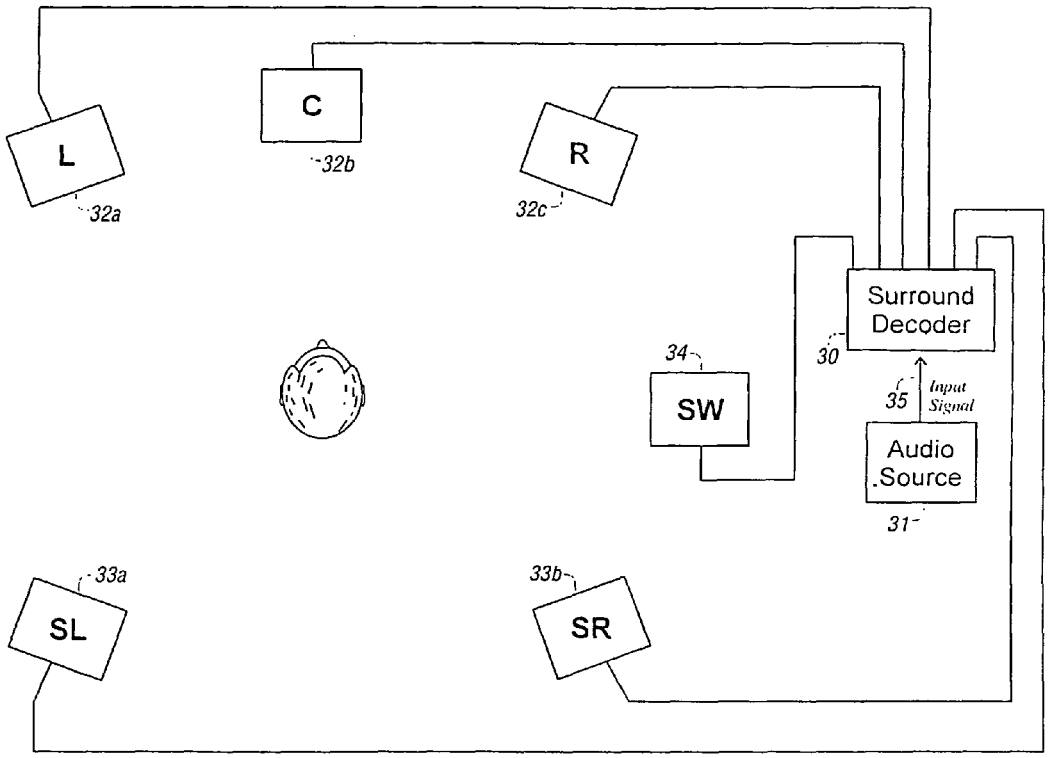
FIG. 3 depicts a known surround sound system.
Figure 4:
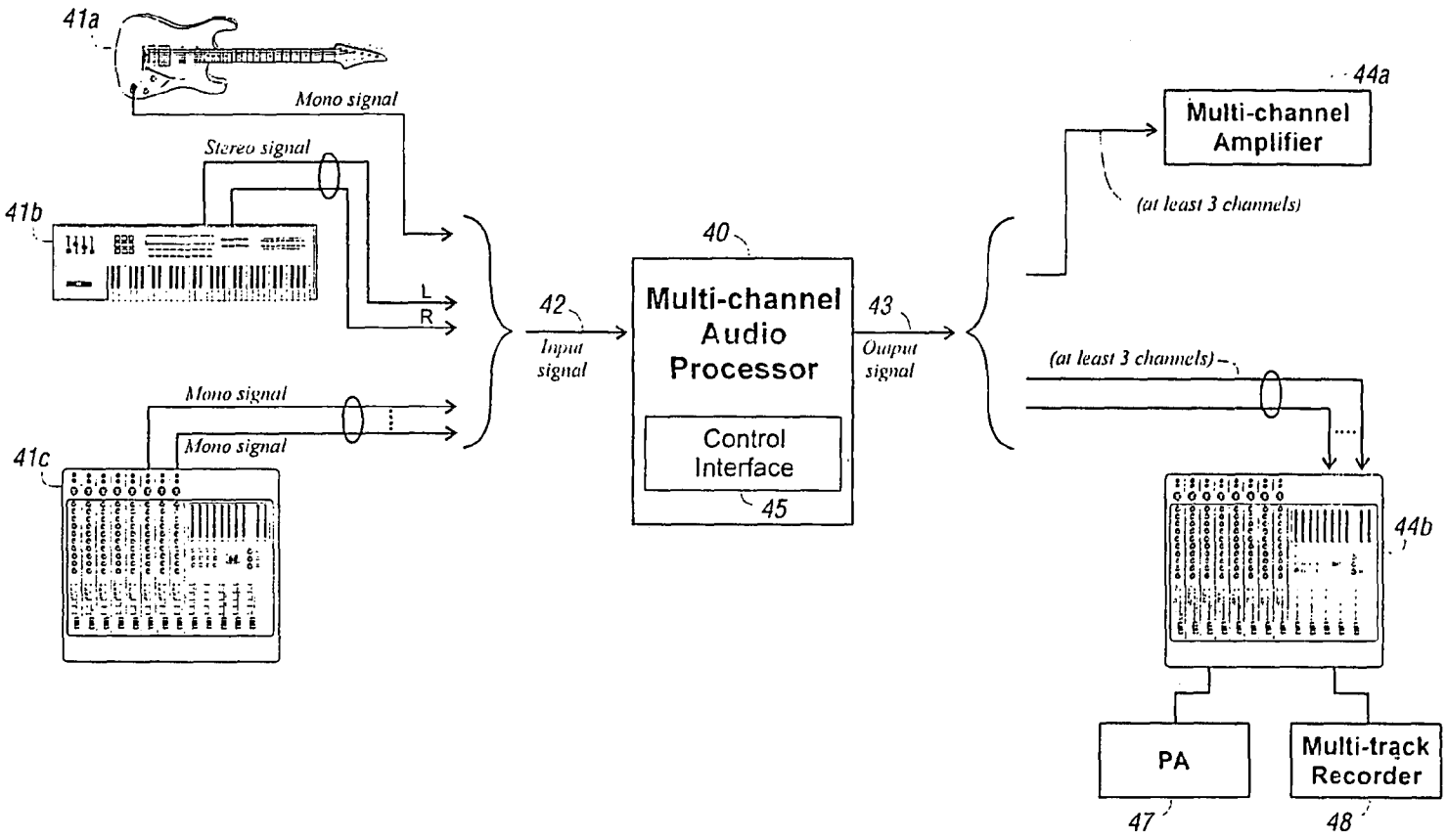
FIG. 4 depicts a multi-dimensional audio processor system according to the present invention.
Figure 5:
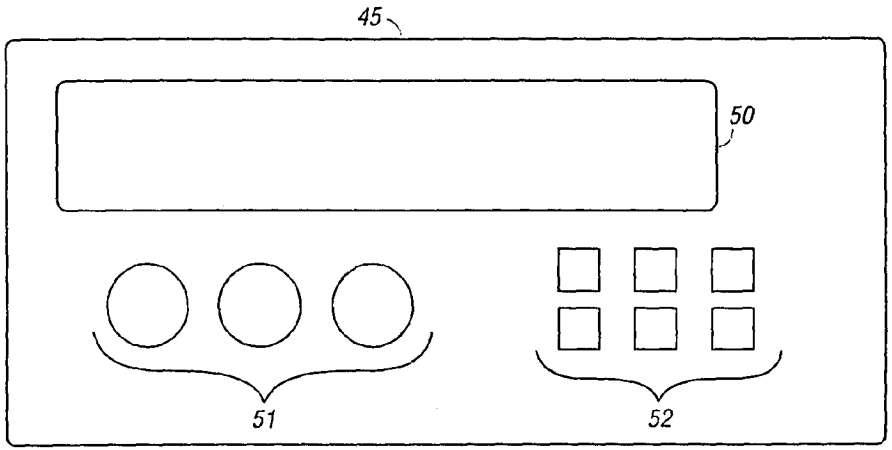
FIG. 5 shows an exemplary control interface for a multi-dimensional audio processor according to the present invention.
Figure 6:
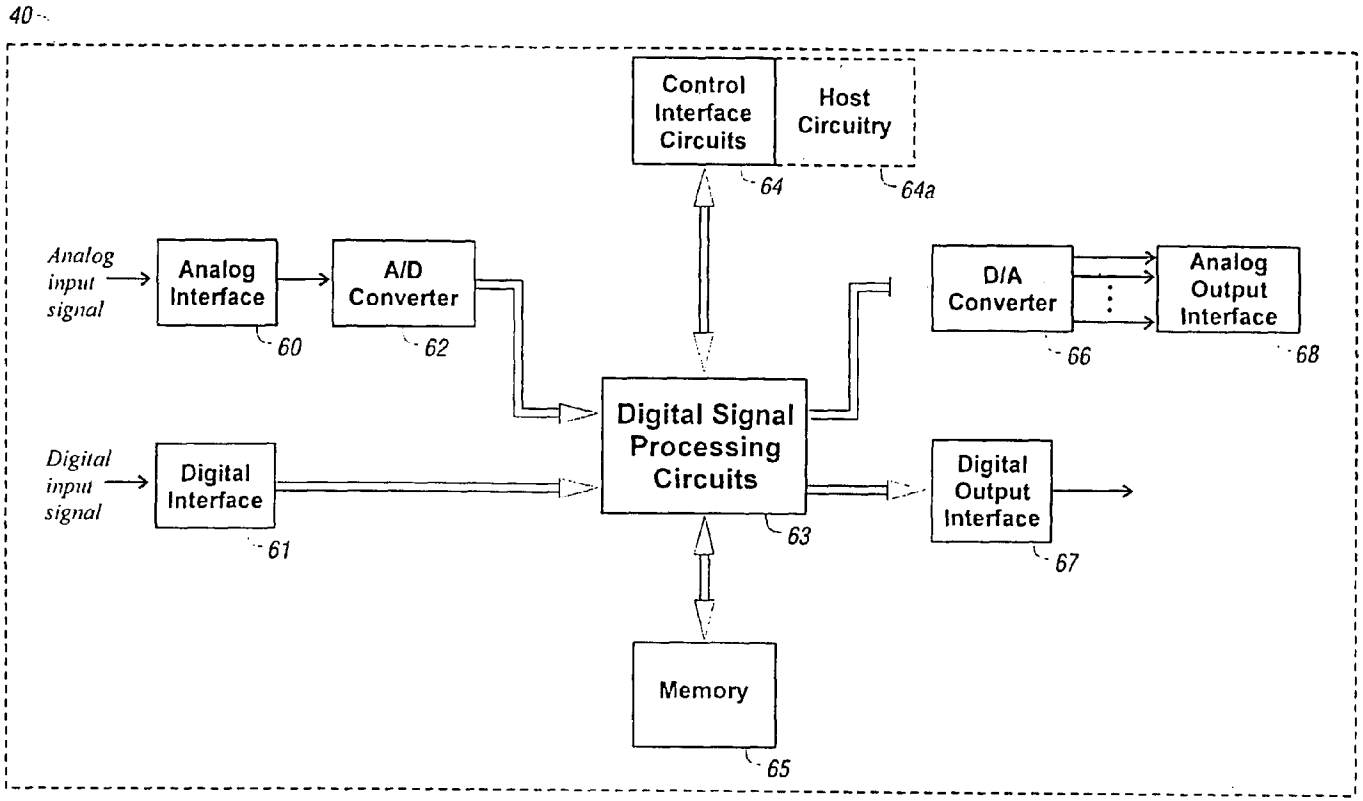
FIG. 6 is a block diagram of a digital embodiment of a multi-channel audio processor according to the present invention.

Turning now to FIG. 4 a multi-dimensional audio processor according to the present invention will be described. Multi-dimensional processor 40 receives input signal 42 from one of the audio sources 41*a-c*, which in a preferred embodiment include musical instruments 41*a-b* or audio mixer 41*c* and, as those skilled in the art will recognize, could also include any source of analog or digital audio signals. Processor 40 can be user programmable, via control interface 45, to provide access to operational controls of processor 40; such as the number of input/output channels, the type/order of effects algorithms to be used, algorithm parameters, mixing parameters for determining output channels signals, etc.; which allow the user to tailor each of the at least 3 channels of output signal 43 for a desired audio result. The channels of output signal 43 can be received by multi-channel amplifier 44*a* or audio mixer 44*b*, which can feed PA system 47 and/or multi-track recorder 48, as desired by the user. FIG. 5 shows an example of control interface 45 which the musician/user can use to access the programmable features of processor 40. Control interface 45 can include knobs 51 and/or buttons 52 which allow the musician/user to define operational controls for processor 40. Control interface 45 can also include display 50 which provides the musician/user with visual feedback of the settings of processor 40. FIG. 6 shows a block diagram of a digital embodiment of the present multi-dimensional processor 40. Processor 40 includes input analog interface and preprocessor block 60 which receives any analog input channels and performs any necessary filtering and level adjustment necessary for optimizing analog to digital conversion of the input channels, as is known in the art, at ND converter block 62, which includes a number of ND converters dictated by the maximum number of input channels. The converted digital channel signals are provided to digital signal processing (DSP) circuits 63. Similarly, digital input interface 61 is provided for receiving input channels which are already in digital format and converting them to a format compatible with DSP circuits 63. DSP circuits 63, which includes at least one digital signal processor such as those in the 56xxx series from Motorola, operate under program control to perform the effect and mixing functions of the instant invention. Memory block 65 is used for program and data storage and as 'scratch-pad' memory for storing the intermediate and final results for the variety of effect algorithms and mixing functions described above. Control interface circuits 64 are comprised at least of control interface 45 described above, and could also include intermediate host circuitry 64*a*, as is known in the art, for interfacing between control interface 45 and DSP circuitry 63 and for providing additional program and data storage for DSP circuitry 63. Output digital to analog conversion of processor 40 output channels is provided by D/A converter block 66, which includes a number of D/A converters dictated by the maximum number of output channels, and the resulting analog output channel signals are provided to output analog interface and postprocessor block 68 for post conversion filtering and level adjustment. Digital output interface 67 is provided for converting the output channel signals from DSP circuitry 63 to a multi-channel digital format compatible with digital audio recording equipment.

Multi-Dimensional Effect Enhancement

Figure 7A:
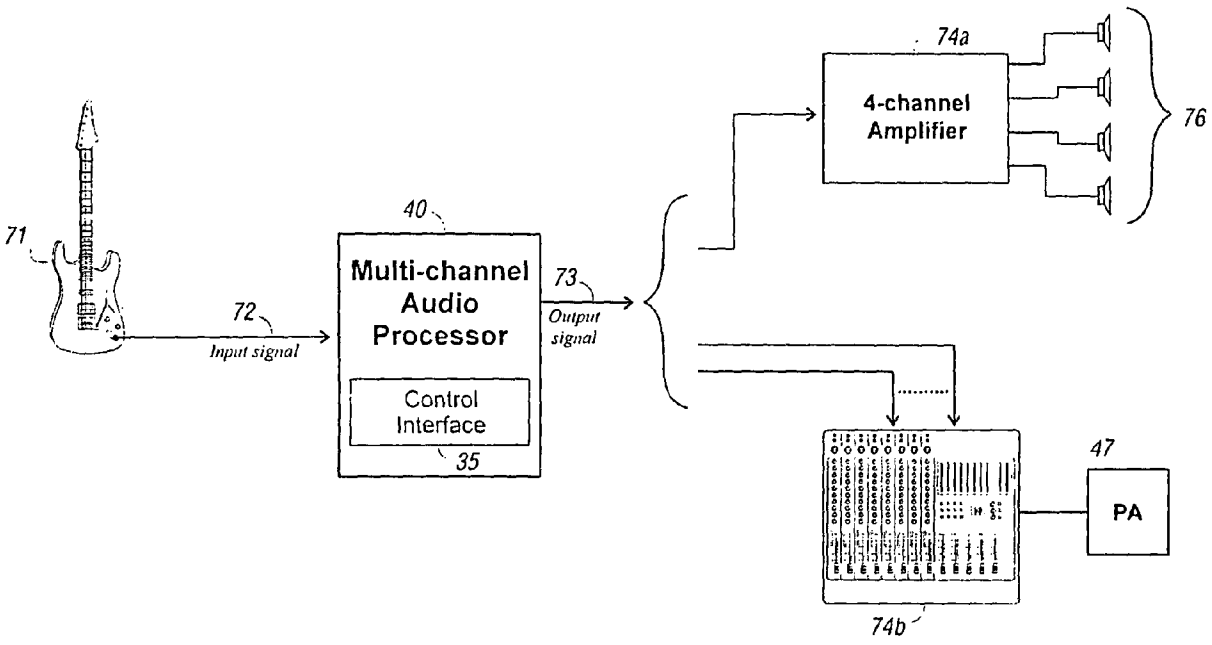
FIGS. 7*a-b* shows a first embodiment of a multi-dimensional audio processor system according to the present invention.
Figure 7B:
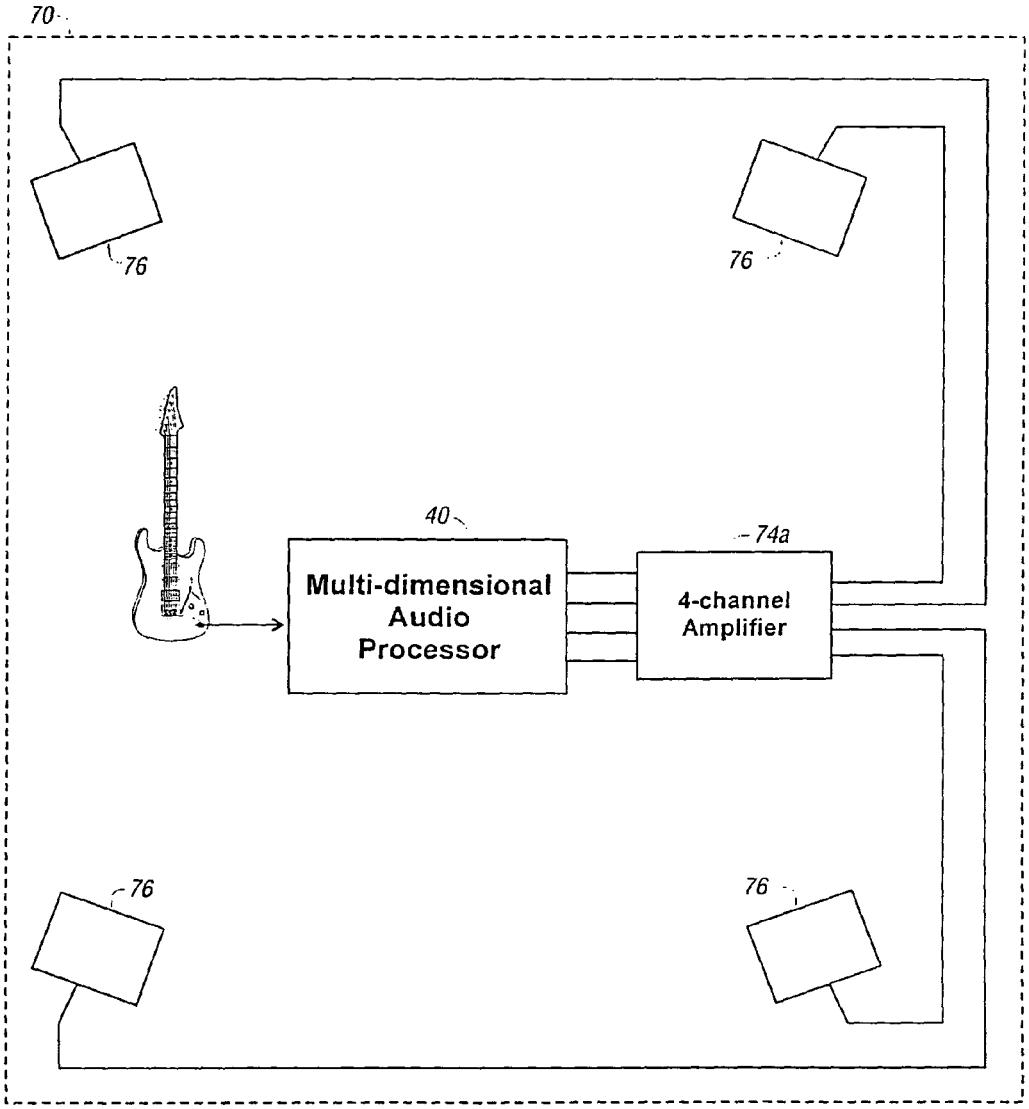

Turning to FIG. 7*a* a first embodiment of a multi-dimensional audio processor system according to the present invention is shown where output signal 73 is comprised of 4 channels. A musician/user of processor 40 would plug an audio source, such as guitar 71, into processor 40 to provide input signal 72. In the case of guitar 71 input signal could be comprised of a single channel or plural channels could be generated by using, for example, a hex pickup which would provide a separate signal for each string of guitar 71. The 4 channels of output signal 73 could be connected to 4 loudspeakers 76 via a 4-channel amplifier 74*a* or to PA 47, which includes its own amplifier/loudspeaker combination (not shown), via 4 inputs of audio mixer 74*b*. As shown in FIG. 7*b*, the musician/user can then position loudspeakers 76 wherever is desired around listening environment 70, including overhead. After positioning loudspeakers 76, the musician/user would operate control interface 45 to program the multi-effect/configuration and mixing functions of processor 40 to generate the desired audio result in each channel of output signal 73, thereby providing an enveloping sound field in the listening environment 70.

Figure 8A:
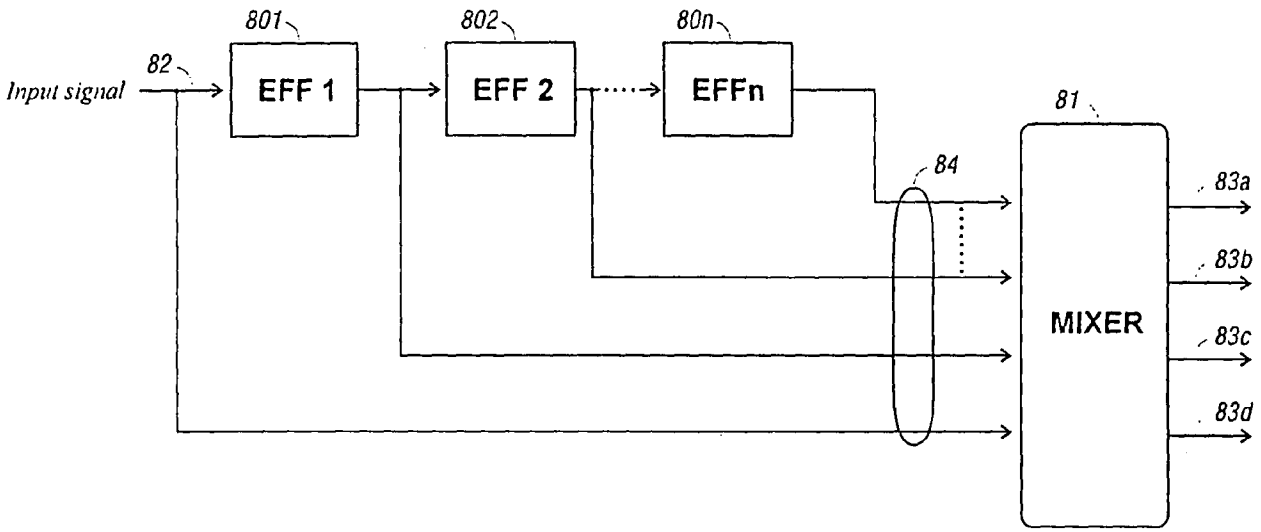
FIGS. 8*a-e* show exemplary user defined effect chains for a multi-dimensional audio processor according to the present invention.

Referring to FIGS. 8*a-e*, example effect chains, which can be fixed or user configurable as is known in the art, are shown. FIG. 8*a* shows an effect chain for a mono input signal 82 which is provided to mixer 81 and the first effect in the chain 801, the output of each successive effect block 802-80*n* is also provided to mixer 81 and serves, in the depicted embodiment, as an input to any subsequent effect block. Effect blocks 801-80*n* can include any type of audio signal processing; especially effects/processing that are well known in the art such as distortion, equalization, chorusing, flanging, delay, chromatic and intelligent pitch shifting, delay, phasing, wah-wah, reverberation and standard or rotary speaker simulation; and can be provided in programmable form by allowing user editing of effect parameters. The effects can also be multi-voiced and thereby provide a plurality of independent effected signals to mixer 81; e.g. a pitch shifting effect can output several signals each with an independently chosen amount of shift. Mixer 81 is operational to receive as mixer input signals 84, input signal 82 and the plurality of effected signals and, for each output channel 82*a-d*, a user can select a subset of mixer input signals 84 which can be anywhere from none (meaning a particular output channel is not active) to all of input signals 84. Once a signal subset is chosen for an output channel 83*a-d*, a user can then set the relative level of each signal in the subset and the subset of signals can then be combined to produce the desired output channel signal. In the case of multi-voice effects, mixer 81 allows a user to direct each effect voice to a different output channel thereby creating an almost limitless variety of multi-dimensional effects. For example different pitch shift voices can be directed to each output channel 83*a-d* in order to surround a listener with different harmony voices or each of multiple delay taps/lines could be directed to a different output channel 83*a-d* so that the delayed signals rotate around the listening environment or 'ping-pong' between the system loudspeakers 76 in predefined or random patterns. In the case of rotary speaker simulation the sound emanating from each loudspeaker 76 could simulate the sound which is directed toward a listening position, from the position of a given loudspeaker 76, in an acoustic environment as the simulated speaker rotates on its axis, thereby imparting a more realistic quality to the simulated rotary speaker sound. For example, as the speaker rotates on its axis, the sound at one point of the speaker rotation will be a direct signal to the listener. With further rotation, the frequency response, pitch and amplitude change with respect to the point source of the speaker itself. The reflected signal from the acoustical environment, as monitored from various point source locations, also provide strong perceptual cues enhancing the realism of the sound. The prior art systems would only provide a mono or stereo representation of the frequency, pitch and amplitude of the rotating speaker as a point source or, at best on a single axis, two point sources as if the rotating speaker were recorded with two different microphones. With the present invention a true representation of the rotating speaker in an acoustical environment representing the reflections from various locations can be emulated. For example, as the speaker rotates to a point where the direct signal is in line with a wall to the right of the listener, the amplitude and frequency response from all of the represented speaker locations can truly emulate the proper response. A five channel system can provide a true impression of the rotating speaker as recorded with five different microphones located at the five locations of the playback speakers. As will be obvious to those skilled in the art the phase, pitch, frequency response, amplitude and delay times from the five locations need to be accurately modeled. Further realism is provided when the continued complex reflections i.e., reverberation of the original listening environment, are also simulated. Alternatively, the 'listening position' could be virtually placed on the axis of rotation for the simulated speaker, thereby giving a listener an impression of being inside the rotary speaker as sound from loudspeakers 76 rotates around the listener.

Figure 8B:
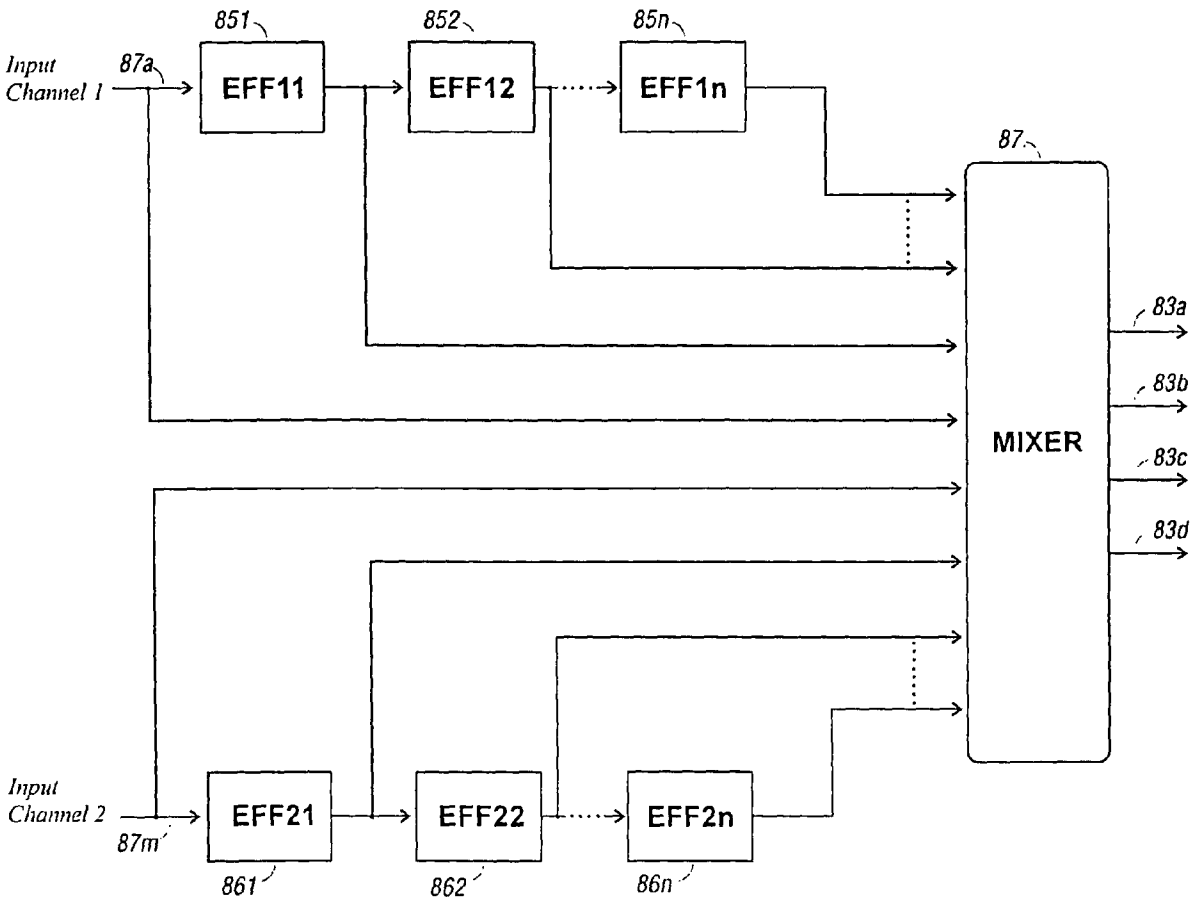
Figure 8C:
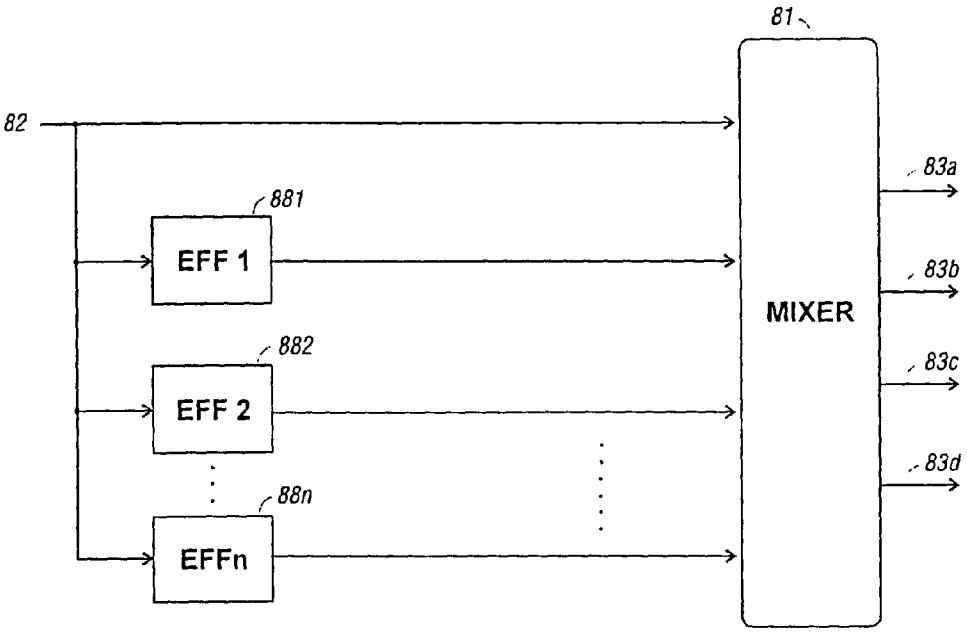
Figure 8D:
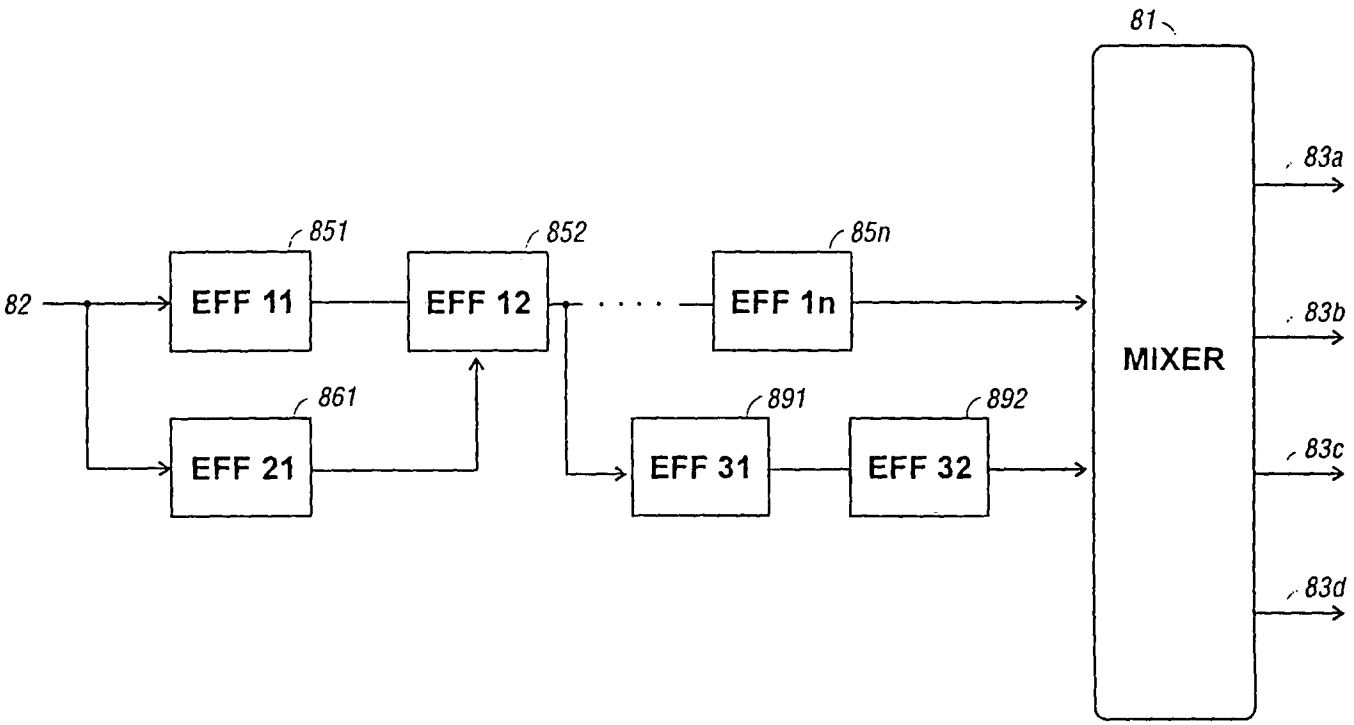
Figure 8E:
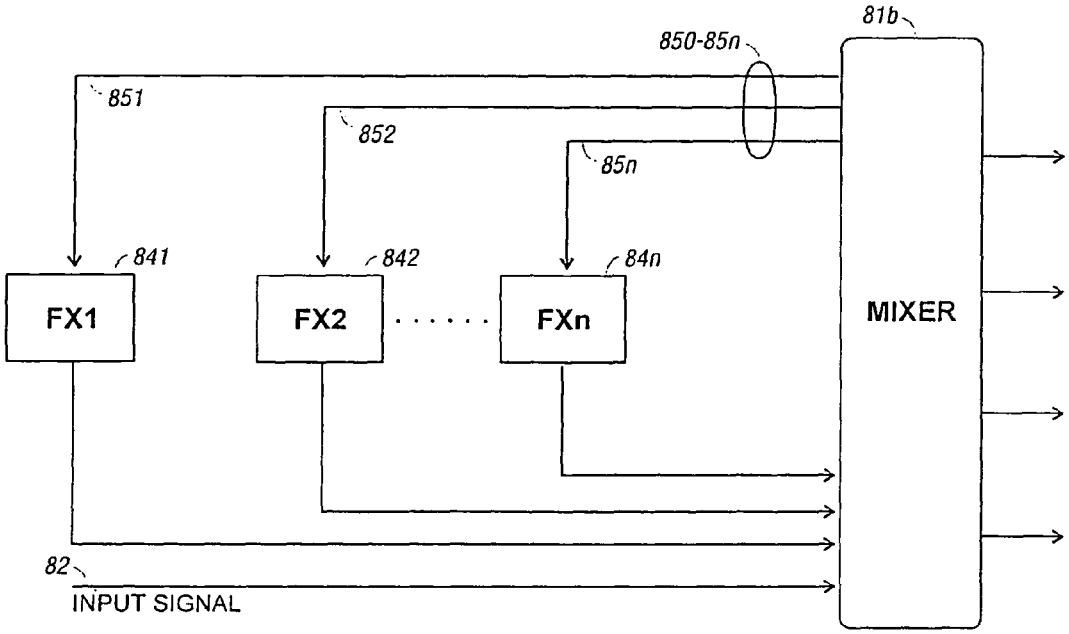

FIG. 8*b* is similar to FIG. 8*a* with the exception that an independent effect chain is provided for each of the plural input channels. FIGS. 8*c* and 8*d* show a parallel effects chain and a combined series-parallel effects chain, respectively, for a mono input signal 82. FIG. 8*e* adds mixer 81*b* to the effect chain of FIG. 8*a*. Mixer 81*b* receives input signal 82 and the signals output from effects 841-84*n* and outputs a respective mixed signal 851-85*n* to the input of each effect 841-84*n*. The operation of mixer 81*b* is similar to that of mixer 81 in that mixed signals 851-85*n* can each be defined as a respective subset of the signals input into mixer 81*b*. In this configuration, effects 841-84*n* can be arranged in almost any series, parallel, or series-parallel combination simply through the operation of mixer 81*b*. For example, if effects 841 and 842 are to be series connected, then mixer 81*b* would be set up to send the output of effect 841 to effect 842 as mixed signal 852 and, for a parallel connection, mixed signals 851-852 would be the same signal and would be delivered to respective effects 841-842. Those of ordinary skill in the art will recognize that a wide variety of effect chain combinations are possible, including configurations where one or more of the effects/processing blocks are in fixed positions in the effects chain, thereby limiting user configurability. It is also possible to sum input channels to mono in order to use a single effects chain for multiple channels in order to realize a reduction in the processing power required to perform the effect and mixing operations. As those skilled in the art will recognize, the number and type of effects available in a particular set of effect chains will depend on the processing power available in processor 40.

Although the embodiments of the present invention discussed above have been described in terms of DSP realization, those of ordinary skill in the art will recognize that equivalent analog embodiments are also realizable by forgoing much of the user programmability/configurability discussed above.

Multi-Dimensional Audio Source Emulation

Figure 9:
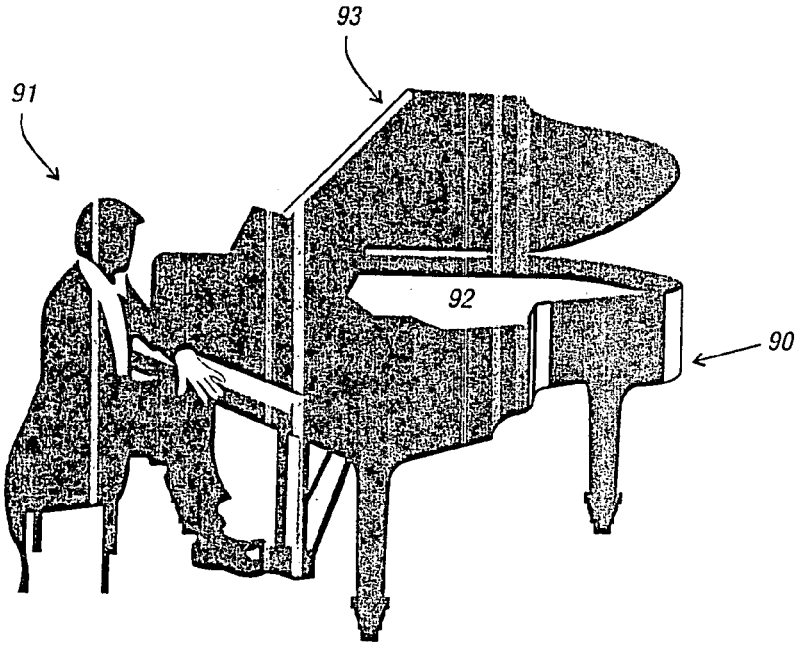
FIGS. 9-11 shows a second embodiment of a multi-dimensional audio processor system according to the present invention.
Figure 10:
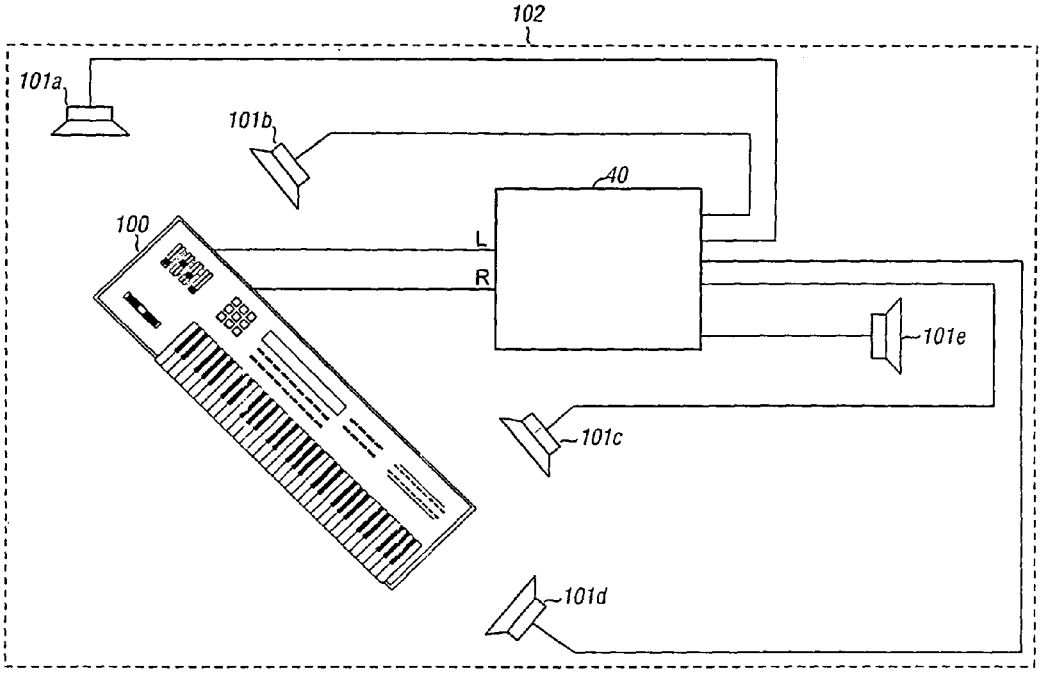

Referring to FIGS. 9-11, a second embodiment of a multi-dimensional audio processor system according to the present invention will be described. In the second embodiment, multi-dimensional processor 40 is used to recreate the spatial impression, or sonic fingerprint, of a musical instrument as a performer would sense it. Turning to FIG. 9, the concept of the sonic fingerprint of an instrument will be described with respect to concert grand piano 90. Concert grand piano 90 has an incredibly large sounding surface. A typical concert grand sounding board 92 is approximately five and one half feet wide by eight feet deep. To performer 91, the perceived sound of the instrument alone, not taking into account the room acoustics, covers a large area which is substantially congruent with the physical structure of piano 90. There are certainly direct sounds from the left and right of the performer, but there is also a substantial amount of sound that comes from the open lid 93 of the piano. The resonance of sounding board 92 and the physical placement of the strings as well as the fact that the lid 93 opens to the right side of the instrument all contribute to the perceived spatial impression of piano 90. Additionally the sonic fingerprint sensed by performer 91 is colored by the location and angle of the open lid 93 and by floor reflections from beneath piano 90. In view of the object of realizing a convincing emulation of the sonic fingerprint of piano 90, there are several alternative methods for deriving the sonic fingerprint from an input signal to processor 40. Continuing with the piano example, a preferred method will be discussed with reference to FIG. 10.

Figure 11A:
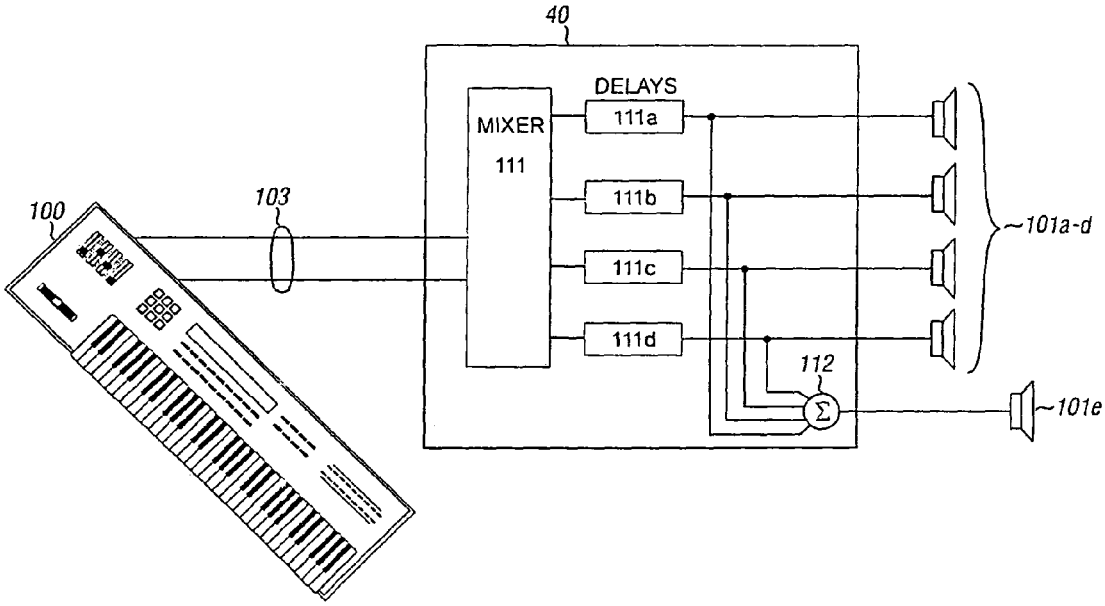
Figure 11B:
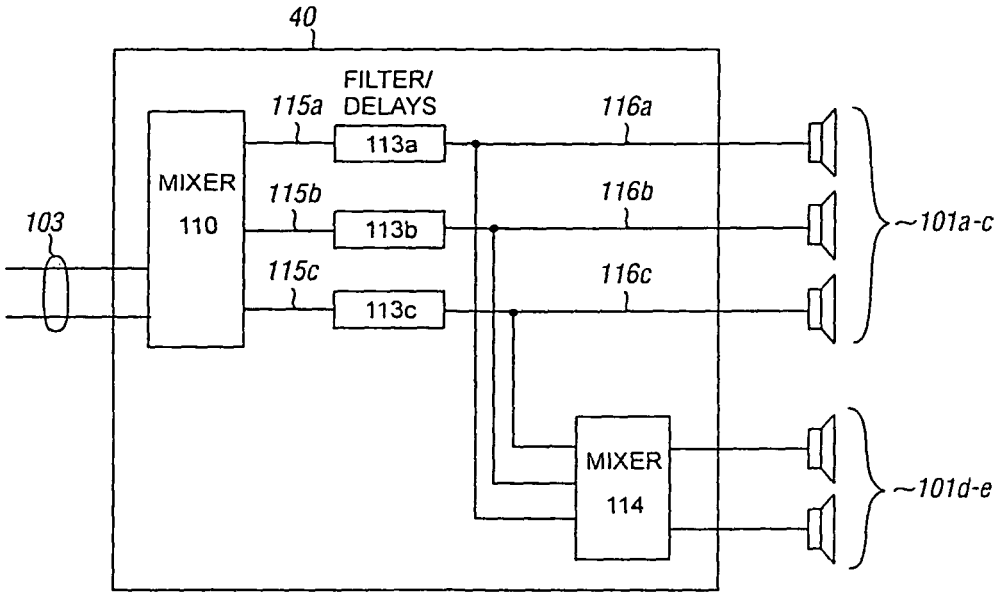
Figure 11C:
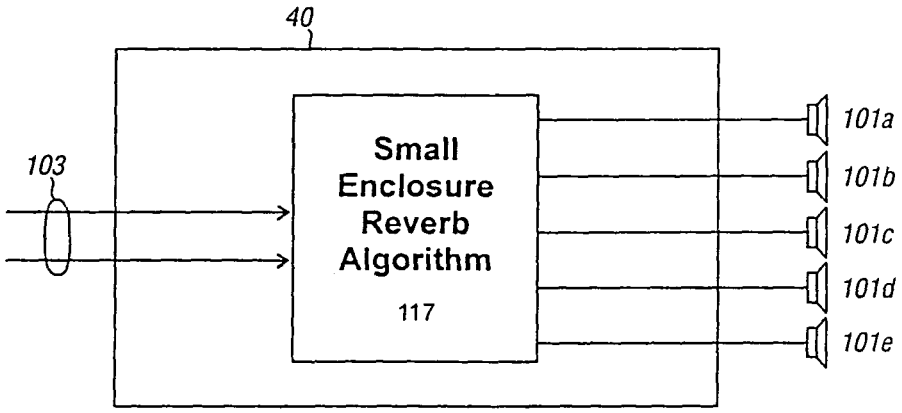

FIG. 10 shows a multi-timbral digital synthesizer 100 connected via its stereo outputs to processor 40. The 5 active outputs of processor 40 are then connected, via respective amplifiers (not shown), to respective speakers 101*a-e*. At least one of speakers 101*a-e*, for example 101*e*, is directed into listening environment 102 in order to excite the acoustic characteristics of environment 102. The remaining speakers 101*a-d*, which are preferably near field monitors, are directed toward the performer at synthesizer 100 and transmit processed versions of input signal 103 in order to emulate the sonic fingerprint of piano 90. Speaker 101*e* transmits a sum of the other speaker signals so that the sound reaching the performer from environment 102 also gives the impression of the sonic fingerprint of piano 90. Speakers 101*a-d* can be positioned near piano outline 104 or closer to the performer at synthesizer 100 with appropriate delays added to their respective signals. FIGS. 11*a-c* show examples of the processing performed by processor 40. In FIG. 11*a*, the left and right channels of input signal 103 are passed to mixer 110 which is operative to provide respective signals for speakers 101*a-d*. In the example case, the respective signals output from mixer 110 are derived from the left and right input channels based on the position of their respective speaker relative to the performer; e.g. the left input channel would be output for the speaker 101*a* positioned to the left of the performer, the right input channel would be output to the speaker 101*d* positioned to the right of the performer, and speakers 101*b-c* positioned between the left and right speakers would receive respective mixes of the left and right input channels. The signals output from mixer 110 are then passed through respective delay lines 111*a-d* to generate the output signals for processor 40. The lengths of delay lines 111*a-d* are determined by the size of piano 90 and the distance from the respective speakers 101*a-d* to the performer. In other words, the lengths of delay lines 111*a-d* are set so that the apparent position of the respective speaker is on or within piano outline 104, thereby imparting the sonic fingerprint of piano 90 to synthesizer 100. For example, if speaker 101*c* is to represent the sound traveling from the furthest point of piano 90 to the performer, which is a distance to approximately 9 feet, and speaker 101*c* is positioned 3 feet from the performer, then a delay of approximately 5.3 milliseconds would be necessary at delay line

111*c* for the speaker to appear to be 6 feet farther away from the performer; i.e. delay=apparent distance−actual distance/speed of sound=9−6/1130=0.0053 seconds.

Turning to FIG. 11*b* a more refined version of the second embodiment of the present invention is shown. In this case, delays 11*a-d* have been replaced by filter/delay means 113*a-c*, summer 112 has been replaced by mixer 114, and a second speaker 101*d* is being directed into the acoustic environment. Filter/delay means 113*a-c* have respective transfer functions for operating on a respective input signal 115*a-c* and generating a respective output signal 116*a-c* for speakers 101*a-c*. Determination of the transfer functions for filter/delay means 113*a-c* can be accomplished by using system identification techniques as are known in the art and discussed briefly below.

In order to find a particular transfer function 113*a-c*, it is necessary to obtain sample output and input signals so that the transfer function can be identified. For the sample output signals anechoic chamber recordings of the sound which is directed toward the player's position from various positions on the instrument; e.g. piano 90; or, as an alternative, binaural recordings, could be used to provide signals which are colored only by the sonic fingerprint of the instrument. For the sample input signals, there are several alternatives among which are:

- recording sample signals as near the point of excitation as is possible (in the case of piano 90 this would mean placing a transducer near the point where the hammer strikes a string, in order to obtain a signal which is substantially not colored by the sonic fingerprint of the instrument);
- physical modeling of the excitation signal (a group of vibrating strings in the case of piano 90, could be used to synthesize an input signal with no sonic fingerprint coloration); or
- the output of synthesizer 100 could be used to provide the sample input signals, thereby providing the transfer functions with the additional property of possibly improving the realism of the synthesized signal.

Additional sample signal possibilities will be apparent to those of skill in the art.

Referring to FIG. 11*c*, another alternative for producing the sonic fingerprint of an instrument is shown. In this case, processor 40 uses small enclosure reverb algorithm 117 to model the acoustic characteristics of an instrument. Input signal 103 is fed into reverb algorithm 117 which treats the physical boundaries of the instrument as the virtual boundaries of a small enclosure in order to generate a reverb characteristic which emulates the instrument's sonic fingerprint. The virtual boundaries of the reverb algorithm 117 can also be made adaptive in order to accurately emulate the effect of, for example, the motion of the sounding board of piano 90.

With the advent of multichannel discrete digital reproduction systems in the home there have been countless discussions among audiophiles of the value of an overhead channel. Continuing with the piano example discussed above, the second embodiment of the present invention can reproduce, along with the left and right perceptions a musician experiences, the sonic perceptions of the grand piano which come from the floor and overhead with respect to the musicians positions. With the previously noted ability to model a very realistic representation of the sonic fingerprint of an instrument, the current invention can bring a listener to a new sonic plateau. Two overhead and/or floor channels can be modeled to allow a very realistic representation of the respective amplitude, phase and frequency characteristics of the concert grand piano. With the proper transfer function corresponding to the physical location of several speakers, as discussed above, a listener can truly be in the performer's location and, with the addition of room acoustics, for example using the virtual acoustic environment discussed below, the emulated concert grand can be transported to any desired acoustical environment. Those of ordinary skill in the art will recognize that the acoustic fingerprint of any number of instruments can modeled and recalled when required.

Multi-Dimensional Musical Instrument

Figure 12:
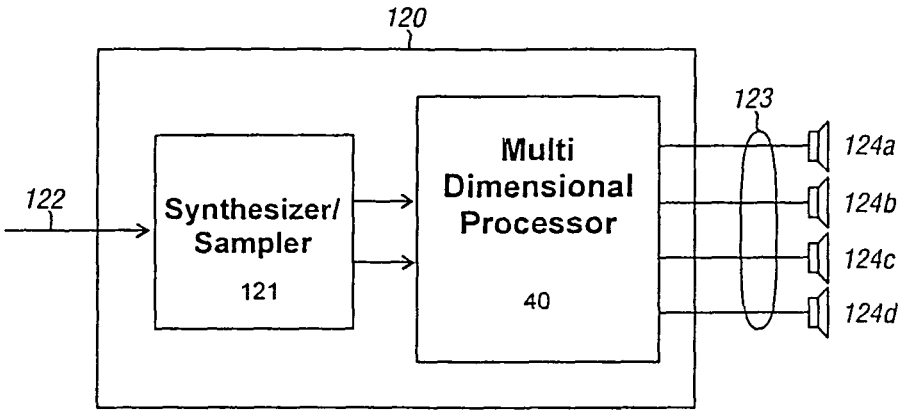
FIG. 12 shows a third embodiment of a multi-dimensional audio processor system according to the present invention.

Turning to FIG. 12, a multi-dimensional musical instrument embodiment of the present invention will be described. FIG. 12 shows a block diagram of multi-dimensional musical instrument 120 which includes multi-dimensional audio processor 40 and a synthesizer/sampler module 121 for providing an input signal to processor 40, which operates as discussed above. Synthesizer/sampler 121 operates under the control of input signals 122 which are, for example, MIDI control signals from a MIDI controller, to provide synthesized or sampled audio signals to processor 40 and thereby multi-dimensional output signal 123 to loudspeakers 124*a-n*. The incorporation of processor 40 with synthesizer/sampler 121 provides a musician/performer with practically an unlimited number of multi-dimensional sounds and effects, within a single unit, for use in composition, recording and/or live performance, which has not been previously available.

Virtual Acoustic Environment (VAE)

Figure 13:
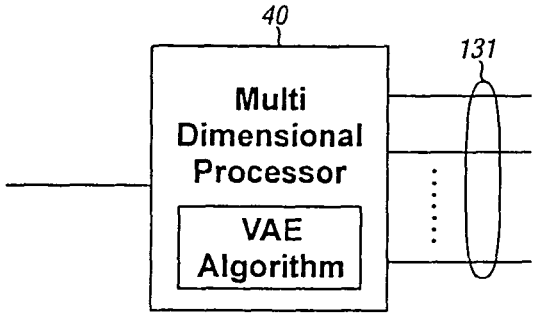
FIGS. 13-15 show a fourth embodiment of a multi-dimensional audio processor system according to the present invention.

According to the fourth embodiment of the present invention there is provided a multi-dimensional processor for emulating the acoustic aspects; e.g. reverberation; of a variety of acoustic environments. In FIG. 13 the input signal to processor 40 is comprised of at least 1 channel and each channel of input signal 130 is treated as a representation of virtual sound waves from an audio signal point source in a virtual acoustic environment (VAE). The acoustic properties of the VAE can be predefined and fixed or can be user defined in terms of the size and shape of the VAE as defined by its boundaries, the acoustic properties of the VAE boundaries, and/or the acoustic properties of the transmission media for virtual sound waves within the VAE. The output signal 131 of processor 40 is comprised of at least 3 channels, each channel representing the virtual sound waves at a respective location within the VAE as an audio signal. The audio signal represented in each output channel can simulate either a listening point or a speaker point. When a listening point in the VAE is simulated the output channel signal represents what a listener at that position within the VAE would hear and when a speaker point is simulated the output channel signal represents the sound waves which would be directed from the speaker point to a predefined listening position within the VAE. The fourth embodiment of the present invention is described in more detail below with reference to the exemplary 3 channel input/5 channel output system shown in FIG. 14.

Figure 14:
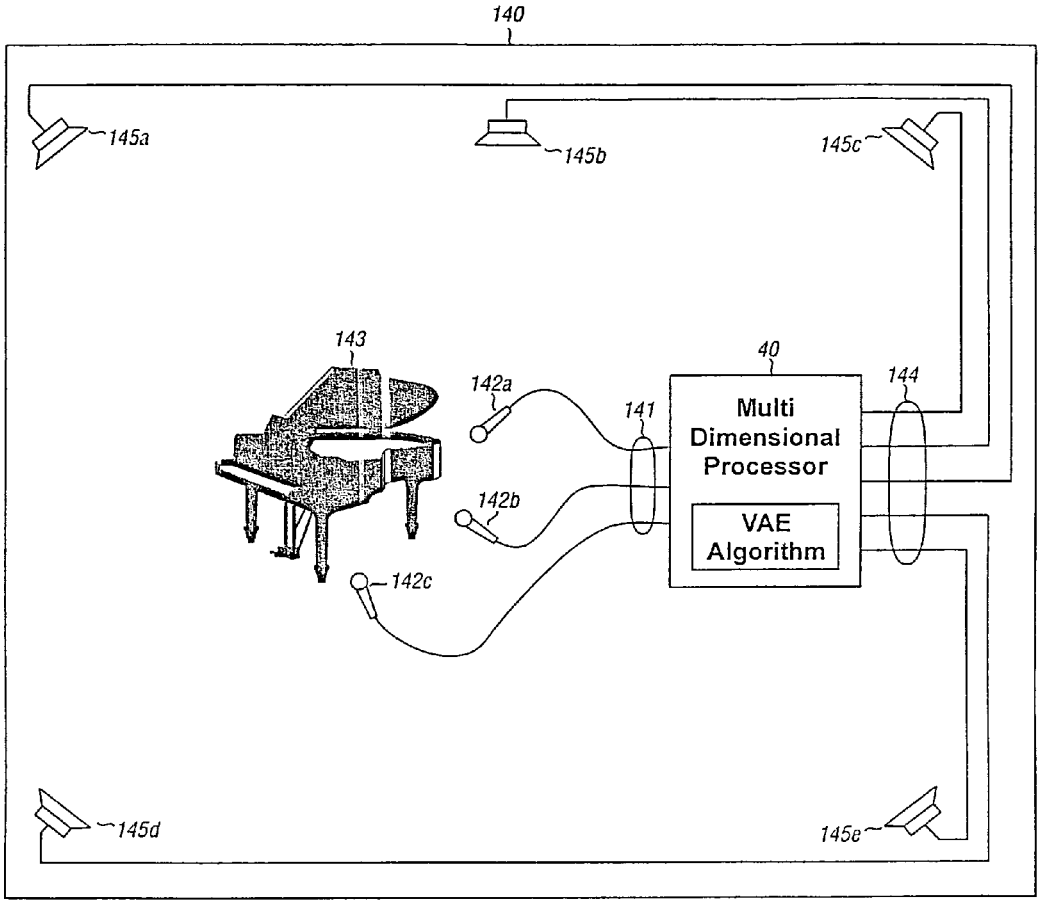
Figure 15A:
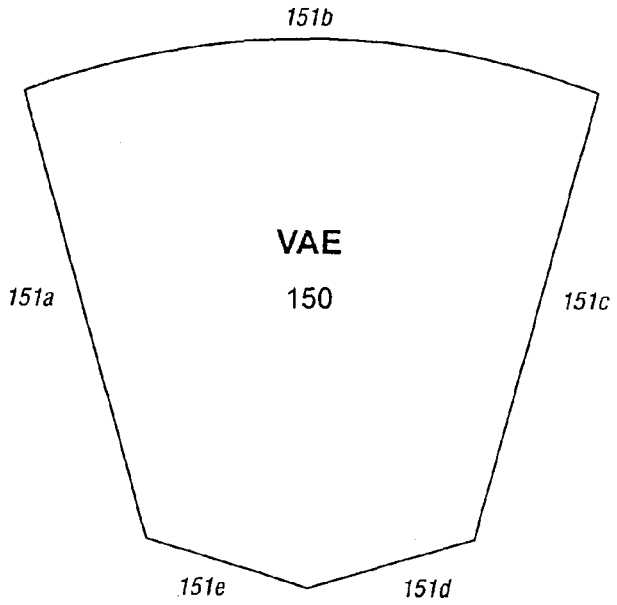
Figure 15B:
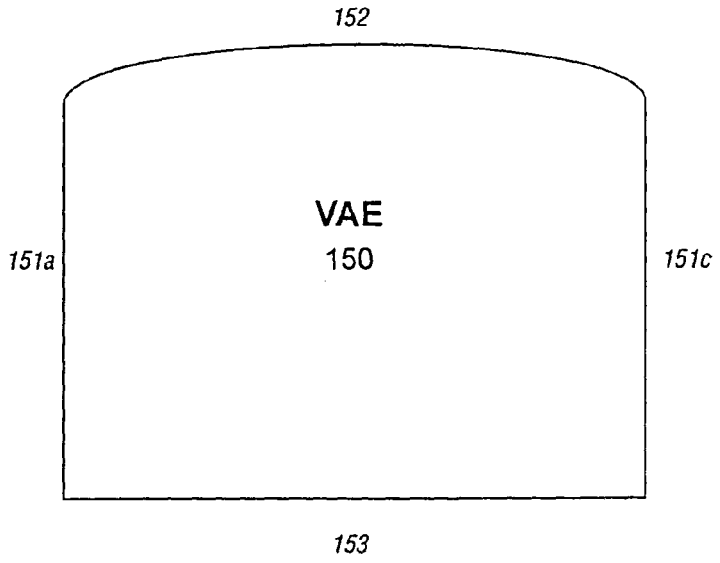
Figure 15C:
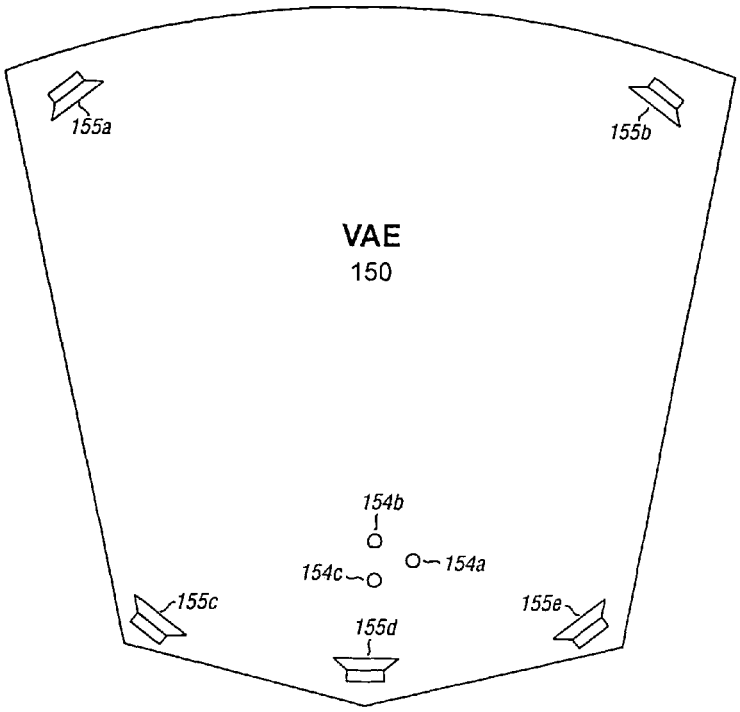

Referring to FIG. 14, a multi-dimensional processor system is shown in listening environment 140. Input signal 141 is comprised of 3 channels, each of which is generated by a respective microphone 142*a-c* receiving, at its respective location, the sound emanated by piano 143. The signals from microphones 142*a-c* are input as the channels of input signal 141 to multi-dimensional processor 40 which has been previously configured to perform as a VAE. Output signal 144 is comprised of 5 channels, each with a respective signal representing a respective listening point or speaker point in the VAE simulated by multi-dimensional processor 40. The channels of output signal 144 can be mixed and/or amplified if necessary and are delivered to loudspeakers 145*a-e* for conversion to audible sound in listening environment 140. Those of ordinary skill in the art will also recognize that the channels of output signal 144 could additionally or alternatively be provided to a multi-track recording unit (not shown) for playback at a later time. Referring to FIGS. 15*a-c*, the configuration of multi-dimensional processor 40 as a VAE will be described. VAE 150 is defined by side boundaries 151*a-e*, upper boundary 152 and lower boundary 153 as shown in FIGS. 15*a-b*. FIG. 15*c* shows an example placement of the 3 channels of input signal 141 within VAE 150 as audio point sources 154*a-c* and the 5 channels of output signal 144 as listening/speaker points 155*a-e*. The positions of audio point sources 154*a-c* within VAE 150, which can be predefined and fixed or can be user positionable anywhere within VAE 50, provide localization of the direct signal image for virtual sound waves from audio point sources 154*a-c* and coupled with proper setup of VAE 150 and positioning of loudspeakers 145 in listening environment 140, according to general surround sound guidelines, allows a listener to sense the audio image of each channel of input signal 141 as being located anywhere in listening environment 140 while maintaining the acoustic ambience of VAE 150. The signals at listening/speaker points 155*a-e* are determined by developing an algorithmic model of the acoustic properties of VAE 150; using, for example, digital filtering techniques or a closed waveguide network, i.e. a Smith reverb; and passing the channels of input signal 141 through the model using the positions of audio point sources 154*a-c* within VAE 150 as signal inputs and the positions of listening/speaker points 155*a-e* within VAE 150 as signal outputs. The model emulates the transfer functions for virtual sound waves traveling from each audio point source 154*a-c* to each listening/speaker point 155*a-e* within the boundaries of VAE 150. The modeled transfer functions can include parameters to account for different transmission media; e.g. air, water steel, etc.; in VAE 150 and for the acoustic characteristics of the boundaries of VAE 150; e.g. the number of side boundaries, the shape of the boundaries, the reflective nature of the boundaries, etc. As a further feature of the present embodiment the modeled acoustic characteristics of VAE 150 could be made to be time-varying or adaptive so that, for example, the transmission media within VAE 150 might gradually change from air to water or some sections of VAE 150 might have one type of transmission media and others might have a different type. Numerous other variations will be apparent to those skilled in the art.

The invention is intended to encompass all such modifications and alternatives as would be apparent to those skilled in the art. Since many changes may be made in the above apparatus without departing from the scope of the invention disclosed, it is intended that all matter contained in the above description and accompanying drawings shall be interpreted in an illustrative sense, and not in a limiting sense.

What is claimed is:

1. A method of processing an at least one channel input signal comprising the steps of:

receiving the input signal in a signal processor having means for producing at least one internally effected signal; and combining the input signal and the at least one internally effected signal to produce at least three output channel signals.

* * * * *